US009776193B2

(12) United States Patent
Burdick

(10) Patent No.: US 9,776,193 B2
(45) Date of Patent: Oct. 3, 2017

(54) DEVICE AND METHOD FOR REMOTE COMMUNICATIONS AND OBJECT LOCOMOTION

(71) Applicant: Charles Burdick, Bend, OR (US)

(72) Inventor: Charles Burdick, Bend, OR (US)

( * ) Notice: Subject to any disclaimer, the term of this patent is extended or adjusted under 35 U.S.C. 154(b) by 78 days.

(21) Appl. No.: 14/804,151

(22) Filed: Jul. 20, 2015

(65) Prior Publication Data

US 2016/0089678 A1 Mar. 31, 2016

Related U.S. Application Data

(60) Provisional application No. 62/057,430, filed on Sep. 30, 2014.

(51) Int. Cl.

| | |
|---|---|
| ***B03C 3/34*** | (2006.01) |
| ***B03C 1/023*** | (2006.01) |
| ***B03C 1/28*** | (2006.01) |
| ***B03C 1/30*** | (2006.01) |

(52) U.S. Cl.

CPC ..... *B03C 1/023* (2013.01); *B03C 1/288* (2013.01); *B03C 1/30* (2013.01); *B03C 2201/16* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,737,638 A * | 4/1988 | Hill | B01D 59/44 | 250/288 |
| 7,939,812 B2 * | 5/2011 | Glavish | H01J 37/08 | 250/281 |
| 7,989,784 B2 * | 8/2011 | Glavish | H01J 37/05 | 250/396 ML |
| 2001/0033128 A1 * | 10/2001 | Torti | H01J 27/026 | 313/359.1 |
| 2004/0031759 A1 * | 2/2004 | Richard | C02F 1/4604 | 210/695 |

* cited by examiner

*Primary Examiner* — Duane Smith
*Assistant Examiner* — Sonji Turner
(74) *Attorney, Agent, or Firm* — Donn K. Harms

(57) ABSTRACT

A device and method is provided for separating associated ions within a gaseous fluid stream into a first population of positively-charged hydrated hydrogen ions and a second population of gaseous hydrated anions. The device employs a housing and spinning wheel within a vacuum chamber to expose a flow of associated ions to a combination of microwaves and magnetic energy within the vacuum to cause bifurcation of the associated ions into a first population of positively-charged hydrated hydrogen ions and a second population of gaseous hydrated anions which may be collected in reservoirs. The collected two populations can be further channeled through a transformer to electrically induce a force for locomotion or communication.

8 Claims, 7 Drawing Sheets

DEVICE AND METHOD FOR REMOTE COMMUNICATIONS AND OBJECT LOCOMOTION

This application claims the benefit of U.S. Provisional Application No. 62/057,430 filed on Sep. 30, 2014, and is included herein in its entirety.

FIELD OF THE INVENTION

The field of the invention relates to a method and apparatus configured for separating charged molecular ions into populations thereof. Thereby isolating gaseous molecular cations from gaseous molecular anions by communicating the separated species into separated populations occupying separate containment vessels. The system is configured to then accelerate one or both of such isolated gaseous ion populations which can be into predetermined containment geometries. So directed in such containment geometries, the rapidly-moving ions cause the projecting of electromagnetic forces useful for both communications and for imparting movement to objects.

More particularly, this invention relates to a gaseous molecular ion transportation equipment system, which can provide unique communications capabilities compared to the prior art and which can also propel or impart movement to objects in a novel manner. Such is accomplished by employing physical, electromagnetic, wave energy and electronic forces to first separate and isolate positively-charged gaseous hydrated hydrogen ions, from negatively-charged hydrated chloride anions, and then by accelerating these separate ion populations electronically, through a unique transformer construction and by further transporting these rapidly-moving gaseous ion species into containment geometries to project useful electromagnetic forces.

BACKGROUND OF THE INVENTION

Electromagnetic force projection has historically taken the form of motile transportation of large numbers of electrons in concentrated currents carried through wires, as are produced by diverse electronic equipment systems. Some examples of these prior art electron transportation systems have included wire-carried electron currents for power transfer, electron motion-induced electromagnetic wave-generating systems for communications, and electron current flow interactions with various magnetic systems for locomotive purposes. The transportation of electrons of the prior art is essentially a subatomic effect.

In contrast to these prior art practices the present invention relates to the motile transportation of large numbers of gaseous molecular ionic species. Thus, the present invention provides a novel system which differs entirely in kind from background electromagnetic force projection practices. However, the present invention, so configured, is particularly useful to improve the application of prior art electron transportation practices, such as remote communications and locomotive force exertion. In doing so however, the present invention expands these capabilities with uniquely useful reductions or modes which are adapted therefor. Moreover, the isolation and transportation of gaseous molecular ions of the disclosed invention, for employment in communications and with locomotive purposes, has not been practiced at all heretofore. Thus, the system and method of the present invention disclosed herein, disclose a completely novel practice.

SUMMARY OF THE INVENTION

The device and method of the system herein, is an unanticipated combination of three components for transporting gaseous hydrated ions. In the system, one such component separates and isolates gaseous hydrated hydrogen ions from their gaseous anionic hydrated counter-ions. Such is accomplished by a combination of wave energy and physical-magnetic transportation. Another component of the disclosed device is a novel electronic transformer which accelerates the isolated gaseous hydrated ions into rapid motion. A third component of the present invention communicates the transformer-accelerated gaseous hydrated ions, into geometrical flow configurations that project useful electromotive forces. The noted components may be employed for the unique steps as singular components, or the components may be configured as a system herein, providing novel utility for the locomotion of objects and for electronic communications.

The system and method herein, separates gaseous positively-charged hydrated hydrogen ions, from their associated gaseous hydrated anions, in a heretofore unanticipated manner. Such is accomplished by introducing hot gaseous hydrated hydrogen chloride vapor, or other hydrated hydrogen halide vapor, into a vacuum chamber housing directly into the midst of a series of fine mesh screens, which are positioned about the outer perimeter of a rapidly spinning wheel located within the vacuum chamber. The wheel imparts a velocity to the ions carried in the gas or vapor exiting into the screens, in the direction of rotation of the wheel. The outer perimeter of the spinning wheel must be located within a strong magnetic field, communicated within the vacuum chamber, such that significant Lorentz force, on the order of $-10^{-15}$ Newtons per charge, is exerted upon the ions when they are communicated within the mesh screen enclosures, engaged with the wheel spinning with at least the perimeter within the magnetic field.

Directly adjacent to the vacuum chamber housing a large electromagnet or several smaller magnets, are positioned. These electromagnets are energized with a wiring direction and resulting current flow yielding the magnetic field, which will split the ions in the gas into two species or populations. Consequently, all positively charged ions traveling in the same direction as the spinning wheel perimeter rotation, within the vacuum chamber of the housing, are impelled in a first population by the communicated Lorentz force, to travel within the vacuum chamber from the perimeter area of the wheel, toward the wheel hub. Conversely, anions traveling in the same direction as the wheel perimeter rotation, are impelled by the formed magnetic field, to travel in a separate second population thereof, in a direction away from the rotating wheel hub.

The magnetic force and velocity communicated to the hydrated hydrogen chloride gas, are not sufficient in combination, to break hydrogen bonds that associate the oppositely-charged hydrated ions with each other. However, the energy maintaining this hydrogen bond is surmounted by the introduction of ionizing microwave energy, by means for generating or communicating microwaves into the localities of the ions, such as a cavity magnetron.

The hydrated hydrogen chloride ions hydrogen bonds are dissociated under the influence of the magnetic field in combination with the applied microwave energy and induced velocity into the two populations. A first population so yielded includes hydrated hydrogen ions, and the second includes hydrated chloride ions. The liberated and oppositely-charged hydrated hydrogen ions and hydrated chloride ions in these separate populations are then impelled, under the influence of Lorentz force, to physically separate from one another.

Such separated populations of ions are then physically communicated using operatively positioned conduits into separate contained volumes by the configured components of the present disclosed device herein. Thus, the accelerated hydrated hydrogen chloride ions exiting into the screen in the presence of a strong magnetic field, and in combination with microwave energy, are subjected to a combined separating force acting upon the opposite charges of hydrated hydrogen chloride gas. Such results in an ion-separation dynamic yielding two opposite ion populations. The nature of the positively-charged hydrated hydrogen ions will predominantly consist of so-called "Eigen" ions, but these can also be in mixtures with other gaseous hydrated hydrogen ion species.

The outer perimeter of the rotating wheel includes the series of fine mesh screens operatively positioned thereon which are preferably coated with acid resistant material such as polytetrafluoroethylene (PTFE) or flexible graphite. These mesh screens present a porous physical barrier which facilitates the separation process of the dissociated gaseous hydrated hydrogen ions from the gaseous hydrated chloride anions. The gaseous hydrated anions, under the influence of Lorentz force and a pressure differential, will communicate toward and exit the top of the mesh assembly engaged with the wheel and communicate into the chamber defined by the interior wall of the housing surrounding the wheel. Thereafter, these gaseous hydrated ions flow by pressure and by entropy differentials through an exit port communicating with the vacuum chamber at the top or upper end of the housing and into a volume reservoir in sealed communication with the exit port.

Concurrently the population of positively-charged gaseous hydrated hydrogen ions, are driven by Lorentz force acting upon them to communicate toward and through the bottom of the assembly of layered mesh screens on the wheel perimeter in a direction toward the wheel hub. This population of positively-charged gaseous hydrated hydrogen ions is then collected through communication thereof through axial cavities of a plurality of hollow collecting spokes or tubes, which are radially arranged on the wheel between the perimeter and hub, to funnel the positively-charged hydrated hydrogen ion vapors, through the axial passage of each of the spokes, and into a first one of the two chambers positioned within a housing of a center hub of the rotating wheel.

The center hub of the rotating wheel is partitioned into a plurality of at least two such chambers such that hot gaseous hydrated hydrogen chloride gas can be injected into one of these chambers of the partitioned inner hub volume, and the hydrogen chloride gas flows through one or a plurality of axial passages of hollow spokes within the wheel assembly which communicate to the outer wheel perimeter where the hydrogen chloride gas enters the series of mesh screens positioned on outer perimeter edge of the wheel.

The second partitioned chamber within the inner wheel hub is employed as a temporary collection chamber for the first population of gaseous positively-charged hydrated hydrogen ions after such have been separated from the second population of hydrated counter ions within the mesh layers, by the means described above. A tube exterior to the wheel hub is connected to the rotating wheel hub through a bearing assembly allowing flow of gaseous hydrated hydrogen ions into this fixed-position tubing while the wheel rotates. This tubing allows the gaseous hydrated hydrogen ions to exit the wheel hub into a reservoir of collection tubes exterior to the wheel assembly, with valving where needed to separate and direct the gaseous hydrated hydrogen ions to flow into other connected device components. The entire series of systems is preferably kept above 35° C. to maintain the hydrated hydrogen ions in a gaseous state.

The gaseous hydrated hydrogen ions exiting the wheel hub as well as the negatively-charged gaseous hydrated chloride anions exiting from the top of the vacuum chamber wheel housing are each collected separately into reservoirs preferably formed as coiled tubing consisting of PTFE or flexible graphite tubing. At least one portion of this tubing coiled around a length of a segment of a magnetic-susceptible central core as part of a transformer device.

On a separate length of this same transformer core numerous wraps of standard electrical wiring are employed that can be powered by an alternating current electrical energy source. The transformer's tubing-wrapped segment, which contains gaseous hydrated hydrogen ions (isolated from the wheel assembly described above) can thus receive energy from the electrically-powered wire-wrapped section of the transformer during its operation.

Similarly the tubing-wrapped transformer segment containing the gaseous hydrated chloride anions, that were isolated from the wheel assembly described above can also receive energy transfer from an analogous electrically-powered section of the transformer during its operation. When alternating current electrical power is applied to the electrically-wired segment of either transformer system the electric power induces rapid motion of the gaseous hydrated hydrogen ions (or alternatively the chloride anion-containing system) within the tubing coils of each transformer system.

These rapidly-moving hydrated ions exiting either transformer can then be utilized potentially in their alternating direction current form as they exit the transformer, or optionally, these alternating direction gaseous ion current flows can be converted into one direction ion current flows by means of a simple magnetic-mechanical gate system discussed further in Example 1. The moving gaseous hydrated ions flowing through the transformer circuit can be directed by various valves to flow into other multiple-looped tubing coils where they can be utilized to exhibit force against any and all systems that exhibit an opposing-direction charge flow. Thus, by means of said force, one variation of the present invention can provide diverse locomotive capabilities for movement of objects, analogous to the actions of electrical magnetic motors known in the art of electronics.

As another alternative in the practice of the present invention, the transported positively-charged gaseous hydrated hydrogen ions flowing through the transformer circuit of the present invention can be employed to transmit unique electronic signals that can be received by other systems that contain concentrated positive charges in an appropriate geometric array and to which are connected suitable amplification and deciphering circuits as are discussed below.

With respect to the above description, before explaining at least one preferred embodiment of the herein disclosed invention in detail, it is to be understood that the invention is not limited in its application to the details of construction and to the arrangement of the components or method steps within the following description or illustrated in the drawings. The device and system herein described and disclosed in the various modes and combinations is also capable of other embodiments and of being practiced and carried out in various ways which will be obvious to those skilled in the art. Any such alternative configuration as would occur to those skilled in the art is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other devices and methods for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

The accompanying drawings, which are incorporated herein and form a part of the specification, illustrate some, but not the only nor exclusive examples of embodiments and/or features of the disclosed device. It is intended that the embodiments and figures disclosed herein are to be considered illustrative of the invention herein, rather than limiting in any fashion. In the drawings.

DETAILED DESCRIPTION OF THE PRESENT INVENTION

Figure 1:
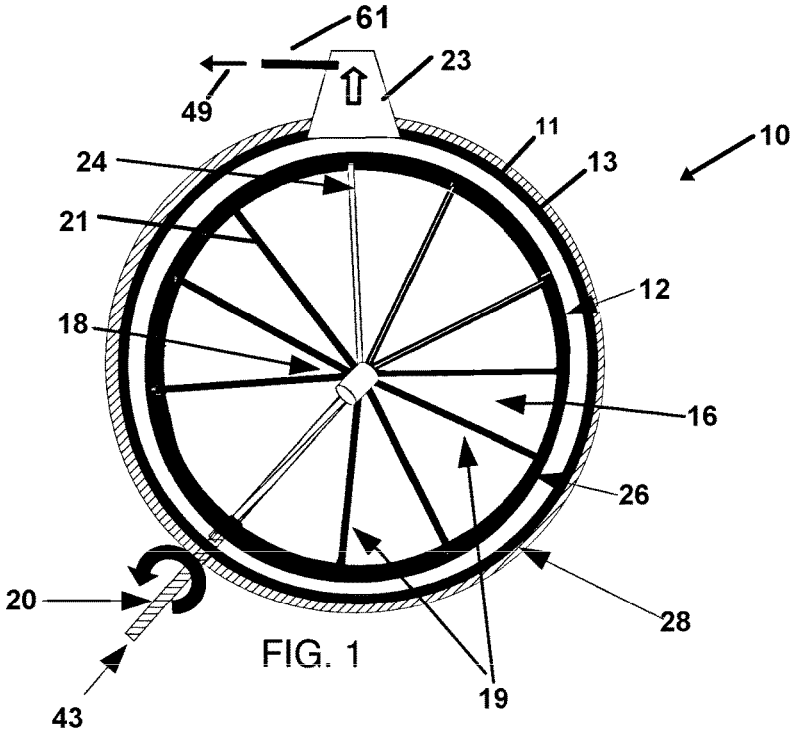
FIG. 1 depicts a depiction of the gas separation component of the present invention.

Now referring to drawings in FIGS. 1-7, wherein similar components are identified by like reference numerals, the disclosed transportation device for gaseous positively-charged hydrated hydrogen ions 33 and negatively-charged hydrated anions 49 may include three separate components:

A first or separation component 10 is shown that applies the physical acceleration force to the associated ions from rotation, and a magnetic force, and microwaves to a communication area 27. A gaseous fluid stream 31 having associated ions separable into a first population of positively-charged hydrated hydrogen ions 33, and a second population of gaseous hydrated anions 49, such as hydrated hydrogen chloride gas, is communicated into and in-between the plurality of screens 26 and within a communication area 27, in order to separate the gaseous hydrated hydrogen ions in the fluid stream from the hydrated anionic chloride counter-ions.

Figure 4:
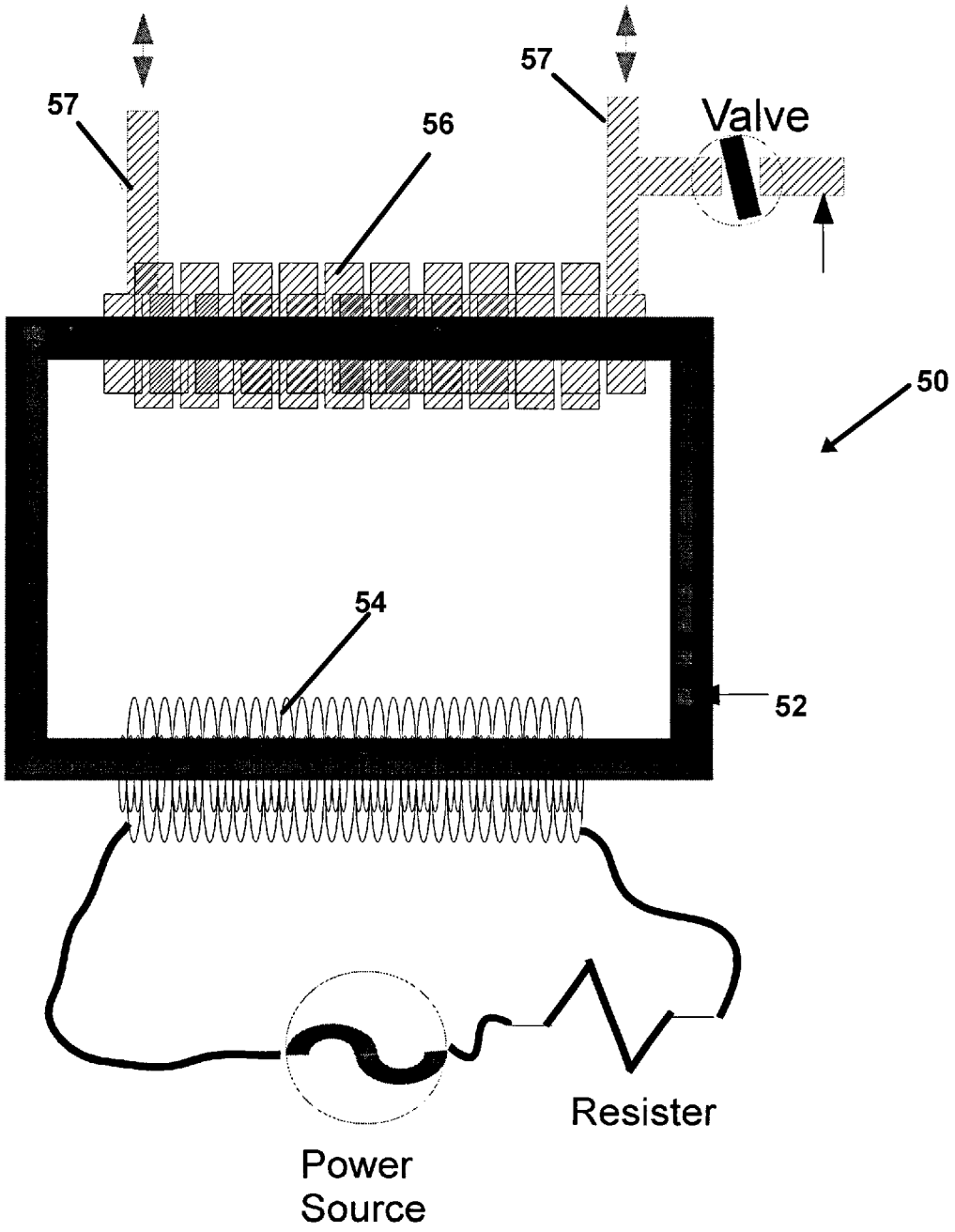
FIG. 4 depicts a hydrated ion gas transformer of the device and system herein.
Figure 6:
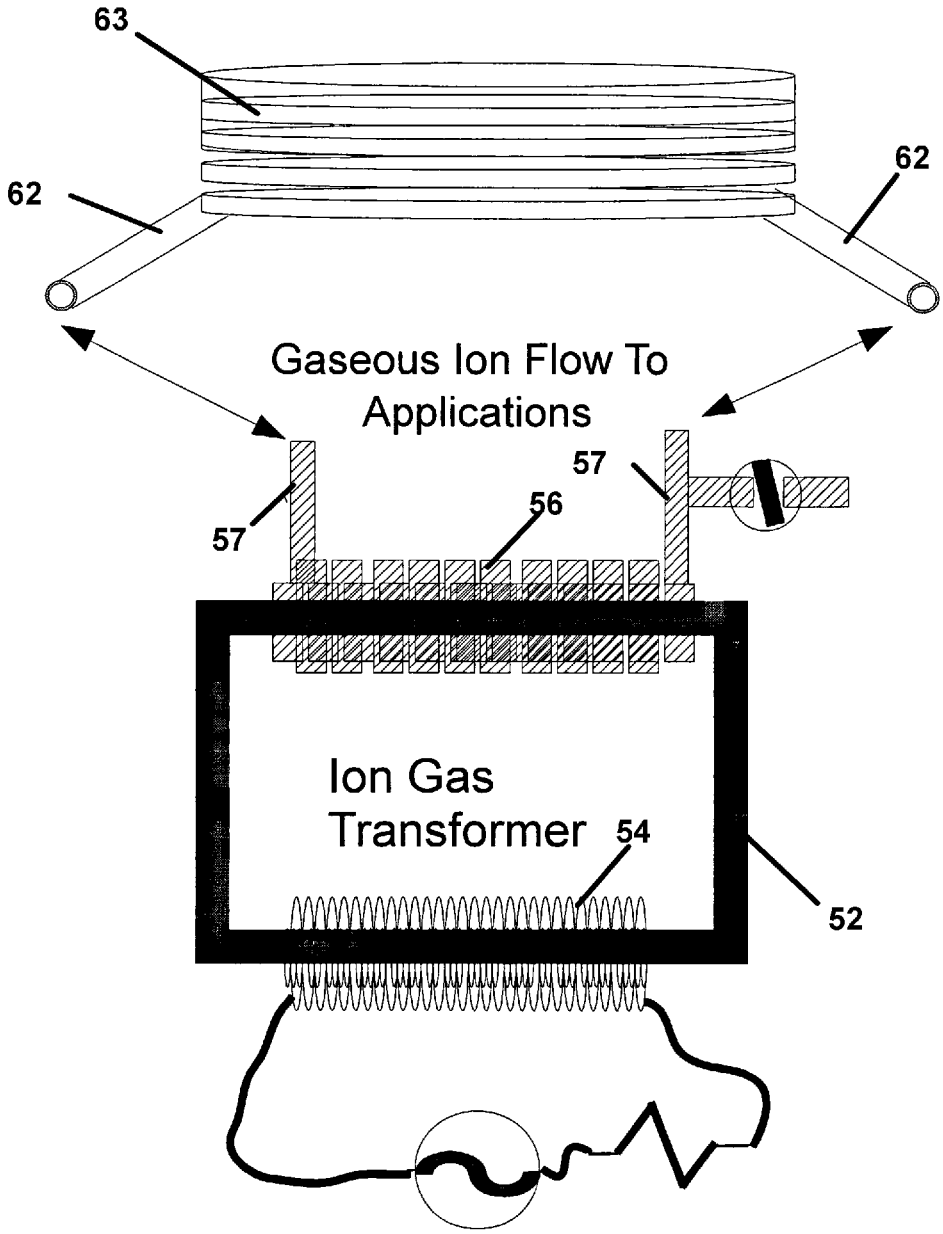
FIG. 6 depicts the transformer of FIG. 5 having a coiled conduit engaged therewith.

A second component such as in FIG. 4 may then be employed which accelerates the motion of either isolated ion species by means of an electrically-powered transformer 50; and a third component such as in FIG. 6, may also be employed which comprises a geometrical assembly of tubing, channels the gaseous current flow of either concentrated hydrated ion species in a manner that projects concentrated electromotive force, for use in communications, or for application of such force to impel motion of objects.

A diagram of the gas separation component 10 for the associated ions in the communicated fluid stream of the present invention is shown in FIG. 1 depicting a first or gas separation component 10 which separates and isolates gaseous hydrated hydrogen ions 33, which are associated with anionic counter-ions 49 in the fluid stream containing the associated ions moving through a communication area. Such is accomplished using an injection assembly, by physical communication of the gaseous fluid stream 31 containing the associated ions to a communication area 27 concurrently with the operative positioning of a magnetic field, and microwaves therein, with the following primary components.

A gas supply system communicates a continuous fluid stream containing associated ions to be split to two populations, such as hot pressurized azeotropic hydrated hydrogen chloride gas, or other hydrated hydrogen halide gas. On the magnet 28 side of the vacuum chamber 12 housing 13 the hollow wheel axle makes continuous volume connection with the hydrated hydrogen chloride gas supply system through an entry port 22 running therethrough. This axle exits through a bearing assembly of the hub 18 at the end of the wheel axle that allows injection gas 31 to penetrate into the first cavity 36 within the wheel hub 18 and axle. On the non-magnet side of the housing 13, a wheel axle portion exits the vacuum chamber 13 through a sealed bearing assembly, and this axle portion defines a rotating drive 20 which may be powered in its rotation by any suitable exterior motor power source via belt or other drive. The fluid stream 31 of associated ions, thus, is supplied to the device 10 herein for example through the entry port 22 (FIG. 2) which is in sealed communication with the first cavity 36 located in the hub 18 of a wheel 16.

This constituent supplying the gaseous fluid stream 31 of associated ions can for example be a simple heated pressure vessel containing preferably a 20.2% aqueous solution of hydrochloric acid in water. Upon heating, such a vessel generates a hot pressurized azeotropic vapor of hydrated hydrogen chloride within the heated vessel which can be continuously introduced to the entry port 22 by means of controllable valves and an acid-tolerant gas flow control, to the other specified components of this invention.

A primary vacuum chamber 12 defined by the interior surface of a wall 11 defining a housing 13 is composed of magnetic-susceptible metal and coated on the chamber 12 interior surfaces with polytetrafluoroethylene (PTFE) or other acid resistant material such as flexible graphite. Within the chamber 12 a non-magnetic mechanical wheel 16 (discussed below) is operatively positioned so that such wheel can be physically rotated around a central hub 18 at high rotational velocity by means of a power drive engaged with an electric motor on one end for example and connected to, for example, a rotating shaft 20 that is external to the vacuum chamber housing. The size of the vacuum chamber 12 defined by the wall 11 of the surrounding housing 13 and may be varied but will generally be of a size that can accommodate a rotating wheel 16 mechanism located within the chamber 12. The wheel 16 that is fitted within the vacuum chamber 12 with close tolerance and as noted is preferably at least one meter in diameter and is preferably, but not essentially, about 3 centimeters in width.

The vacuum chamber 12 as noted, also has ports including an entry port 22 (FIG. 2) for a communicated pressurized hydrated hydrogen halide gas, into a first cavity 36 within the wheel hub 18 for communication to the axial cavities of and surrounding spokes 19 in a spoke assembly extending between the hub 18 and circumference of the wheel 16. Also included are at least two exit ports, a first exit port 43 for gaseous hydrated hydrogen ions and a second exit port 23 for exhausting of gaseous hydrated anions, as is further described. A vacuum may be applied as needed through either the first exit port 43 or second exit port 23 to aid in exhausting the two populations from the vacuum chamber 12.

The vacuum chamber 12 also has one or a plurality of input ports 24 for communicating microwave energy generating component such as a magnetron, which is directed to intersect the opposing mesh screens 26 positioned on the outer wheel circumference described below in a communication area. The wheel 16 has attached on its outer perimeter edge 29 a screen assembly defined by a plurality of mesh screens 26. Currently, a plurality of ten or more layers of fine mesh screen 26 of a 200 mesh each are positioned one on top of the other in close proximity between each layer of mesh screen 26 in the screen assembly.

Figure 3:
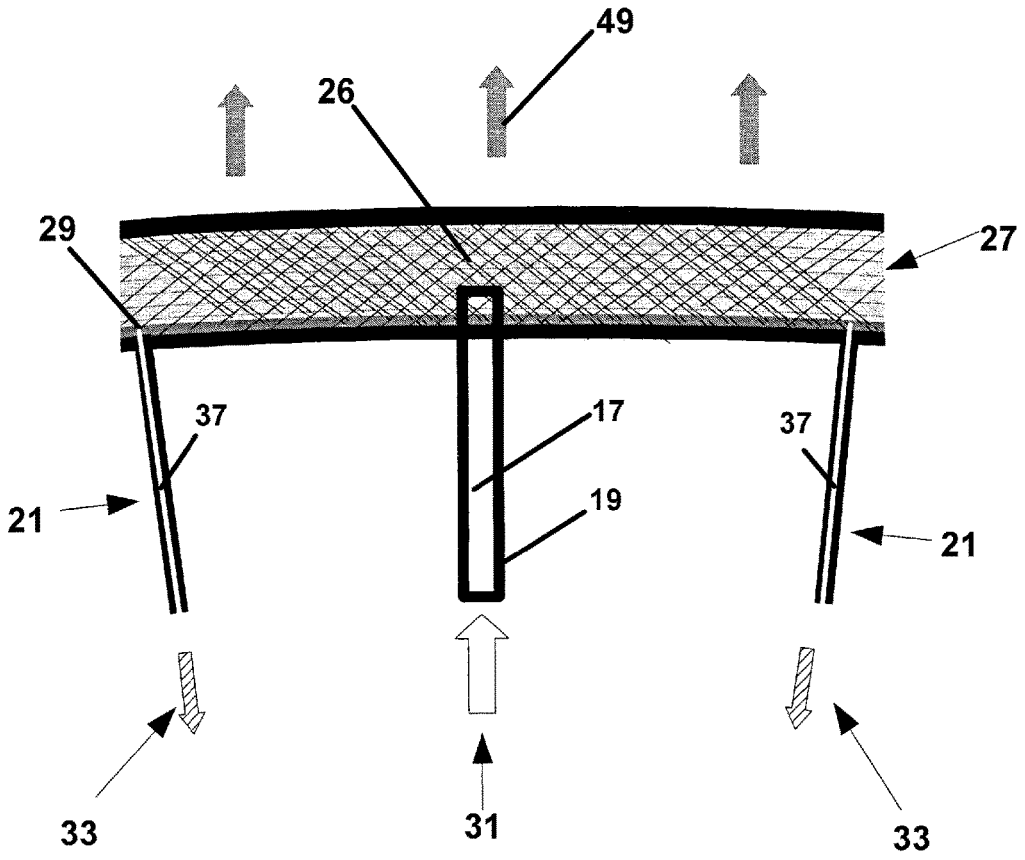
FIG. 3 is a schematic of a segment of the circumferential edge of the wheel showing the screen portion located thereon and gas flows of the device.

The outer edges of these screens 26 are sealed to the outer edges of the wheel perimeter edge 29. The porous openings of the fine mesh screens 26 are positioned above and parallel to the top of the solid outer wheel perimeter edge 29. Within the solid outer wheel perimeter edge 29 surface of the wheel are embedded a number of hollow spokes 19 that extend down to the wheel hub 18. The spokes 19 are drilled into the wheel axle and reach into its inner volume such that the hollow interior volumes of the spokes are in communication with one cavity positioned within the hub interior, but these are otherwise sealed from the vacuum within the chamber 12. A schematic drawing of the mesh layers on the wheel's perimeter is shown in FIG. 3.

The vacuum chamber 12 within the housing 13 has several of the input ports 24 positioned on one side, directly opposite to the side of the housing 13 adjacent to the magnet 22 location and each of the input ports 24 is adapted to introduce microwave energy into the housing 13 to the vacuum chamber 12. These several microwave input ports 24 are preferably arranged in a circle that is aimed at the communication area 27 adjacent the outer wheel circumference and in-between the inner wall of the housing 13 and a pair of mesh screens 26.

Figure 1A:
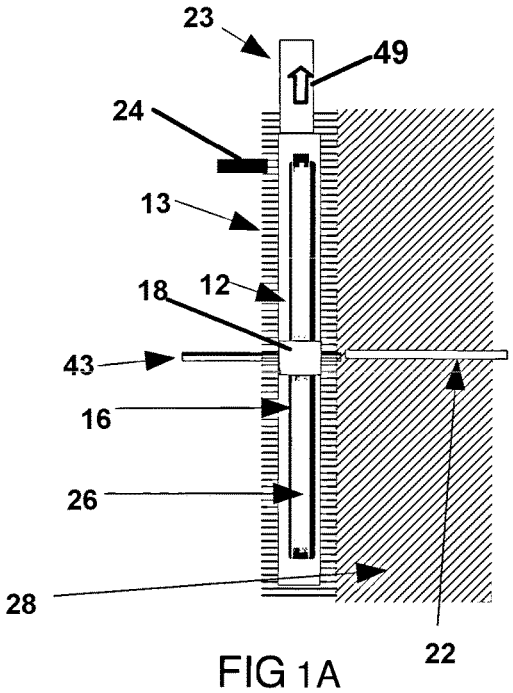
FIG. 1A shows a side view of the device of FIG. 1 depicting the gas inlet assembly and gas outlet assembly of the separation component.

The microwave energy is employed to break hydrogen bonds of the hydrated hydrogen chloride gas which has been communicated into the chamber 12 to the communication area 27, so as to cause ionization thereof. A schematic view showing a cross section of the vacuum chamber 12 within the housing 13 and the rotatable wheel 16 assembly and some primary associated system constituents are shown in FIGS. 1 and 1*a*.

A large circularly wound electromagnet 28 is positioned and configured to project a magnetic field into the communication area 27 substantially in excess of at least 20,000 Gauss and preferably at a level exceeding 40,000 Gauss within the primary vacuum chamber 12 defined within the housing 13. The diameter of the electromagnet 28 is preferably equal to or greater than the diameter of the vacuum chamber housing 13, such that the circumference of this magnet 28 in operative position adjacent the housing 13, overlaps a circumference of the rotating wheel 16 positioned within the vacuum chamber 12 described below and as diagramed in FIG. 1.

The primary vacuum chamber 12 within the housing 13 is attached by PTFE-coated or flexible graphite conduits, such as tubing 32, to be in communication with two volume reservoirs exterior to the vacuum chamber housing 13. These exterior volume reservoirs may consist entirely of conduits or tubing coated with or composed entirely of PTFE, or can be otherwise configured for holding the intended output of the tubing 32.

One of the two formed reservoirs is configured to collect gaseous chloride anions which are emitted from the vacuum chamber 12 within the housing 13 during the operation of this component. The second volume reservoir is configured to collect one population of gaseous positively-charged hydrated hydrogen ions. The volume reservoir that collects hydrated anion vapors preferably has an input entrance at the second exit port 23 the top of the primary vacuum chamber housing 13. The volume reservoir that collects hydrated hydrogen ion vapors employs the rotating wheel 16 as a collection port as is described below.

The mechanical wheel 16 is configured for rapid rotational movement and is powered for such rotation by an external drive system located within the magnetized vacuum chamber 12 defined by the interior surface of a wall 11 forming the housing 13. This wheel 16 imparts an acceleration to the associated ions in the fluid stream exiting the wheel 16 in a communication area and serves as one force for separating the fluid stream into gaseous hydrated hydrogen ions, from gaseous hydrated anionic counter-ions. The size of the wheel 16 is optional but generally will have between 0.5 and 1.5 meters, or greater outside perimeter circumference. However, other wheel circumferences are anticipated as would occur to those skilled in the art so long as the vacuum chamber 12 and housing 13 and magnets are properly configured as described herein.

This wheel 16 and spokes 19 communicating between a hub 18 and the circumference, and other components included in the wheel assembly, are preferably entirely composed of nonmagnetic material. The wheel 16 is preferably coated on all exterior surfaces and interior surfaces with PTFE or graphite or other acid resistant material.

Figure 2:
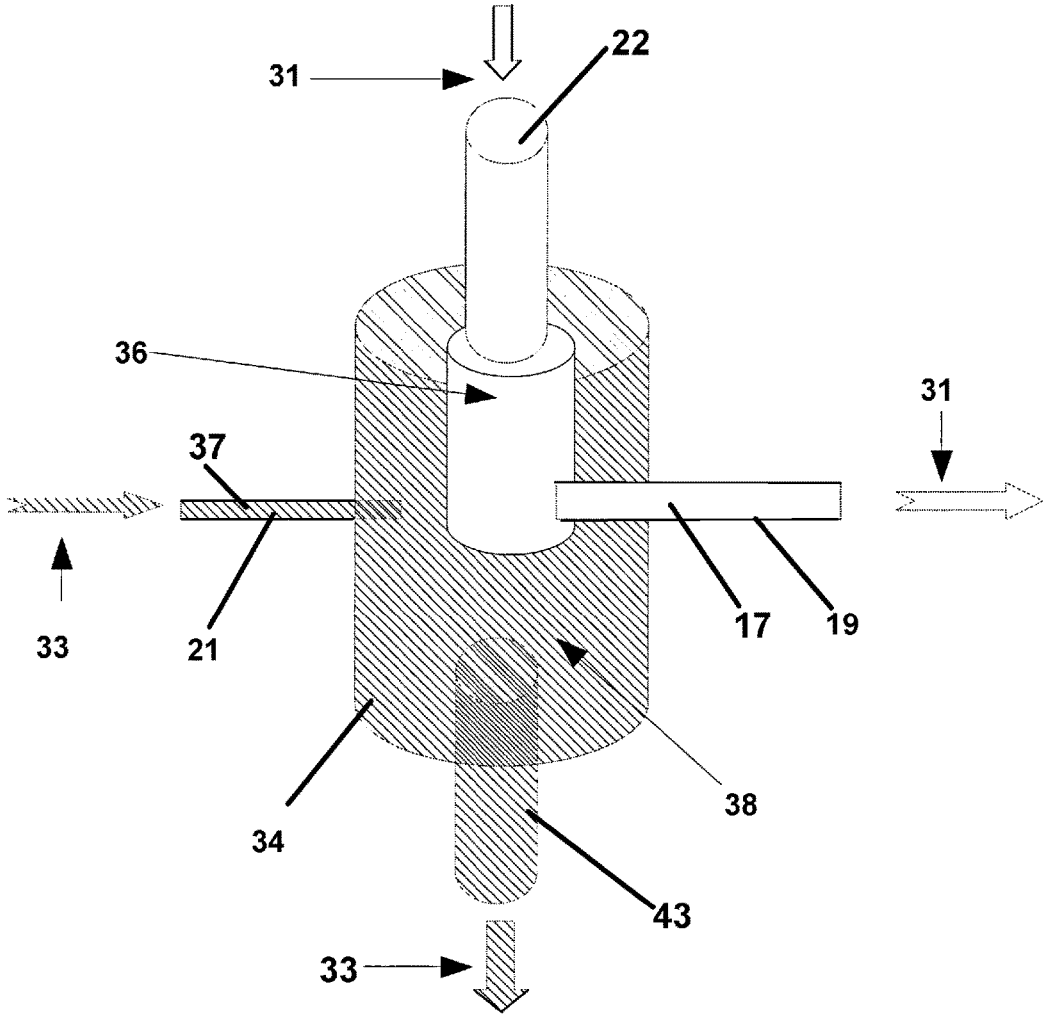
FIG. 2 depicts the wheel hub and an inflow cavity and outflow cavity thereof.

The central hub 18 of the wheel is hollow to form a cavity 34 which may include two separate unconnected chambers. A first chamber 36 functions as a gas inflow chamber, and the second chamber 38 is configured as an outflow chamber as shown in FIG. 2. In operation, the inflow or first chamber 36 formed within the cavity 34 at the wheel hub 18 receives a flow of hot gaseous hydrated hydrogen chloride gas as the fluid stream of associated ions 31 from an external source through an axial conduit of an entry port 22 (FIG. 1*a*) through a sealed bearing assembly as described above. This gaseous fluid stream, for example hot hydrated hydrogen chloride gas, is under pressure and will flow out of the first chamber 36 of the wheel hub 18 through an axial passage in one or more spokes 19 that deliver the gas or fluid stream of associated ions 31 through an exit and into a communication area 27 where the mesh screens 26 positioned on the outer perimeter edge of the wheel 16 of the wheel assembly.

The wheel 16 has attached on its outer perimeter edge one or preferably a plurality of fine mesh screens 26 spaced apart and running parallel and formed of non-magnetic material. The screens 26 are coated on their outer surfaces with PTFE, or graphite, or other acid resistant material, as shown schematically in FIG. 3.

The mesh size of the mesh screens 26 can vary. Currently however, a substantially 200 mesh which has a gap or cross section between mesh fibers of substantially 74 microns or a finer mesh above a 200 wire mesh which will have a smaller micron cross section is one preferred mode of the mesh. The fluid stream containing the associated ions to be split into separate populations, such as hot hydrated hydrogen chloride gas, is communicated through the entry port 22 under pressure into first chamber 36 within the cavity 34 in the wheel hub 18. The same level of pressure causes it to flow from the first chamber 36 of the cavity 34 through one or more axial passages 17 running through the spokes 19 of the wheel 16 to flow into the inner layers of the wire mesh screens 26 in the communication area 27 within the chamber, to facilitate an ion separation process therein.

Underneath or adjacent the wire mesh screens 26 as part of the wheel 16 outer perimeter edge 29, one or a plurality of secondary hollow spokes 21 having axial pathways 37 therein, are positioned around the entire perimeter of the wheel 16 such that they serve as gaseous hydrated hydrogen ion collection ports and passages. These spokes 19 and 21 are treated on their internal surfaces defining the axial passages and pathways, and exterior surfaces, with PTFE or other acid resistant material such as flexible graphite.

The hollow secondary spokes 21 extending radially around the hub 18 of the wheel 16 are positioned beneath and adjacent the mesh screens 26 in order to collect hydrated hydrogen ion gas 33 during the rotation of the wheel 16 within the chamber. So collected, axial pathways 37 running through the secondary spokes 21 communicate these collect ions to the ionized gas collection chamber or second chamber 38 of the wheel hub 18.

A gas injection assembly provided by the entry port 22 in communication with the first cavity 36 which is in sealed communication with an axial cavity 17 through spokes 19, is configured to inject the hot fluid stream 31 into the communication area 27 positioned within the layers of mesh screens 26 forming the screen assembly upon the perimeter edge 29 of the wheel. Such is depicted in the confections shown in FIGS. 1-3.

This injection of the incoming fluid stream 31 is preferably directed to pass in-between the middle screens of the plurality of 200 mesh wire mesh screens 26 in the communication area 27 within the layered screen assembly noted herein. The rate of fluid stream 31 injected is optional but preferably this should be regulated so that the pressure change within the vacuum chamber 12 increases slowly from 0 Pascal to substantially 5000 Pascal over the course of about 20-60 minutes. The inside diameter of the axial passages 17 and pathways 37 of the hollow wheel spokes 19 and secondary spokes 21, can be variable but generally an inside diameter size of 1-4 mm for each is preferable. The inner hub cavity 34 of the wheel hub 18 to which the axial passages running in the wheel spokes communicate, is connected through a sealed bearing assembly to a long extant of PTFE tubing, and as the wheel is rotated, this tubing emanating from the wheel hub 18, does not rotate.

During operation of the apparatus the separated population of gaseous hydrated hydrogen ions within the communication area 27, flow downward through the wire mesh 26 into the axial pathways 37 of the secondary spokes 21 of the wheel assembly. From there are communicated into the outflow wheel hub chamber, or second chamber 38, and then exit the wheel hub 18 into a long series of PTFE or flexible graphite tubing which may serve as the collection reservoir for positively-charged hydrated hydrogen ions.

A general schematic of the wheel hub 18 partitions showing first chamber 36 and second chamber 38 and respective connections thereto are shown in FIG. 2. Operation of this first component of the present invention involves first heating the pressurized vessel containing a gaseous mixture for the fluid stream of associated ions, such as a 20.2% HCl/water solution so that a hot gas of azeotropic hydrated hydrogen chloride is available to supply the other equipment sections. The vacuum chamber 12 and the two connected volume reservoirs are then evacuated to about complete vacuum. The entire system must be heated and preferably kept above an operating temperature of 35° C.

Mechanical torque from an external power drive such as an electric motor (not shown) is operatively communicated to the rotatable wheel 16 within the primary vacuum chamber 12. From the communicated rotational power the wheel 16 is accelerated to a perimeter velocity greater than 50 meter/sec and preferably greater than 100 meter/sec. The magnet, such as an electromagnet 28 adjacent to the vacuum chamber 12, is then energized to exert a magnetic flux within the vacuum chamber 12 in the communication area 27, of preferably equal to or greater than 40,000 Gauss. It is possible that permanent magnets of a size and magnetic strength to communicate the magnetic flux to the communication area 27 may be used. However, currently an electromagnet 28 is most preferred due to the ability to vary the current direction and power thereto for adjustments to the system during operation.

After energizing the electromagnet 28, the gaseous stream of associated ions 31, for example of 200° C. hot 20.2% HCl/water azeotropic vapor under pressure, is slowly injected into the wheel hub first chamber 36 with the gaseous fluid stream 31 then flowing to the communication area 27 by employing the same pressure to penetrate into the wire mesh screen 26 assembly affixed to the outer perimeter of the rapidly rotating wheel 16 in a communication area 27. Ionizing microwave energy is also applied to the mesh screen 26 around the wheel perimeter into the communication area 27 in order to further disrupt hydrogen bonds associating the one population of positive hydrated hydrogen ions 33, with the other population of negatively-charged hydrated chloride anions 49 in the gaseous fluid stream 31 of associated ions.

The direction of wheel rotation is coordinated with the Gauss generated within the communication area 27 by the wiring direction of the electromagnet 28, such that any separated positive ions 33 traveling within the communication area 27 about the wheel perimeter are compelled or urged to travel in a downward direction, or toward the hub of the wheel, in accordance with Lorentz parameters. Concurrently, any free anionic hydrated ions 49, moving in this same direction of wheel perimeter rotation, are forced or urged to travel away from the rotating wheel perimeter toward the second exit port 23.

This system enables the population of positively-charged hydrated hydrogen ions 33 from the gaseous mixture to penetrate downward through the PTFE coated fine mesh screens 26 in the communication area 27 positioned at the outer wheel perimeter, in stages. Simultaneously, the population of hydrated anion gas ions 49 or vapors are forced through the top of the fine mesh screens 26 in the communication area 27, and in turn these anions 49 exit through the second exit port 23 into the anion collection volume reservoir 39. This differential in ion travel directions results in a pronounced ion separation dynamic that concentrates each molecular ion species into separate collection volume reservoirs.

The positively-charged hydrated hydrogen ions 33 enter the axial pathways 37 in the hollow wheel secondary spokes 19, below the wire mesh screens 26 and travel further toward to the second chamber of the wheel hub 18, eventually exiting the wheel hub 18 through a sealed bearing into a length of tubing constituting the hydrated hydrogen positive ion reservoir 41, exterior to the moving wheel hub 18. Conversely, the negatively-charged hydrated chloride anions 49 are evacuated from the top of the vacuum chamber 12 through tubing 61, engaged with the second exit port 23, into a second tubing anion reservoir 39 external to the primary vacuum chamber 12 defined within the housing 13.

The pressurized injection of hot hydrated hydrogen chloride azeotropic gas into the first chamber 36, of the wheel hub, is continued until the pressure in the entire system reaches a level of just under 5000 Pascal, after which valves of both ion reservoirs located exterior to the wheel vacuum chamber housing 13 are both closed in order to isolate the separated ion populations, and so make them available for further transport within a second transportation component of the present invention. Concurrently, the flow of pressurized hot gas having the associated ions therein, into the first chamber 36, is discontinued.

The second hydrated hydrogen ion transportation component of the present device includes a novel transformer 50 shown in FIG. 4. A section of the tubing containing the hydrated ions of either species or population (isolated by the first component of the present invention discussed above), may be operatively communicated about a transformer 50 subjected to an alternating electrical current within the transformer design of the present invention as a tubing reservoir.

The tubular volume reservoirs of this example consist of 100 meters total of 0.5 cm outside diameter PTFE tubing or flexible graphite tubing that is in a sealed engagement with each side of the vacuum chamber 12 such that at the end of the gas pressurization cycle and separation of the associated ions in a fluid stream 31, approximately 100 meters volume reservoir of anionic hydrated chloride gas or negatively-charged hydrated anions 49 is collected through the vacuum chamber top side exit port of the equipment, while concurrently approximately 100 meters of tubing containing hydrated hydrogen ion gas or positive gaseous ions 33 collected through the spokes 19 of the hub 18. Either tubing volume reservoir can be subsequently utilized in the transformer and application transportation components systems of this invention. In order to further transport and ultimately utilize the two ion populations contained in either of the tubing volume reservoirs recovered from operation of the separator component, these gaseous hydrated ionic species are first valved off from exiting the vacuum chamber 12, and subsequently either gaseous ion population may be energized within the transformer or second transportation component of the present invention.

In the transformer, a rectangular-shaped transformer metal core 52 is wrapped on one long side with standard electrical wiring 54, powered by a standard alternating electric current. The opposite long side of the transformer core 52 is wrapped with PTFE-lined tubing 56 containing hydrated molecular ions isolated by the first component of the present invention. When alternating electrical current is applied to the electrical wiring 54 on the first side of the core 52 of such a transformer, this action transfers energy from the electrically powered side wiring 54 of the transformer 50, to the gaseous charged hydrated molecular ions in the tubing 56 on the opposite side of the transformer 50, thereby inducing rapid acceleration of these ions. Operation of the gaseous hydrated ion transformer system is practiced by applying the alternating current to the electrically-wired segment of this system using a typical, but not limiting, electrical current application to the transformer which would include a 60 Hz with a power application of 10,000 watts. However, other oscillation rates and wattage levels may be employed as would occur to those skilled in the art and such are anticipated since size of the core and wiring 54 and distance of transmission will affect such and the optimum oscillation rate and wattage can be calculated or derived from simple experimentation. Such an alternating current application to the electrically-powered segment of the transformer induces rapid alternating direction motion of gaseous hydrated ions flowing in the tubing 56 segment of the transformer system.

The tubing 56 containing these accelerated ions is in turn connected to a circuit 57 that applies the moving ions' energy in functional applications such as communications or object locomotion, as are described below. These applications of course are not limited to communications and object locomotion as is further described below.

Figure 5:
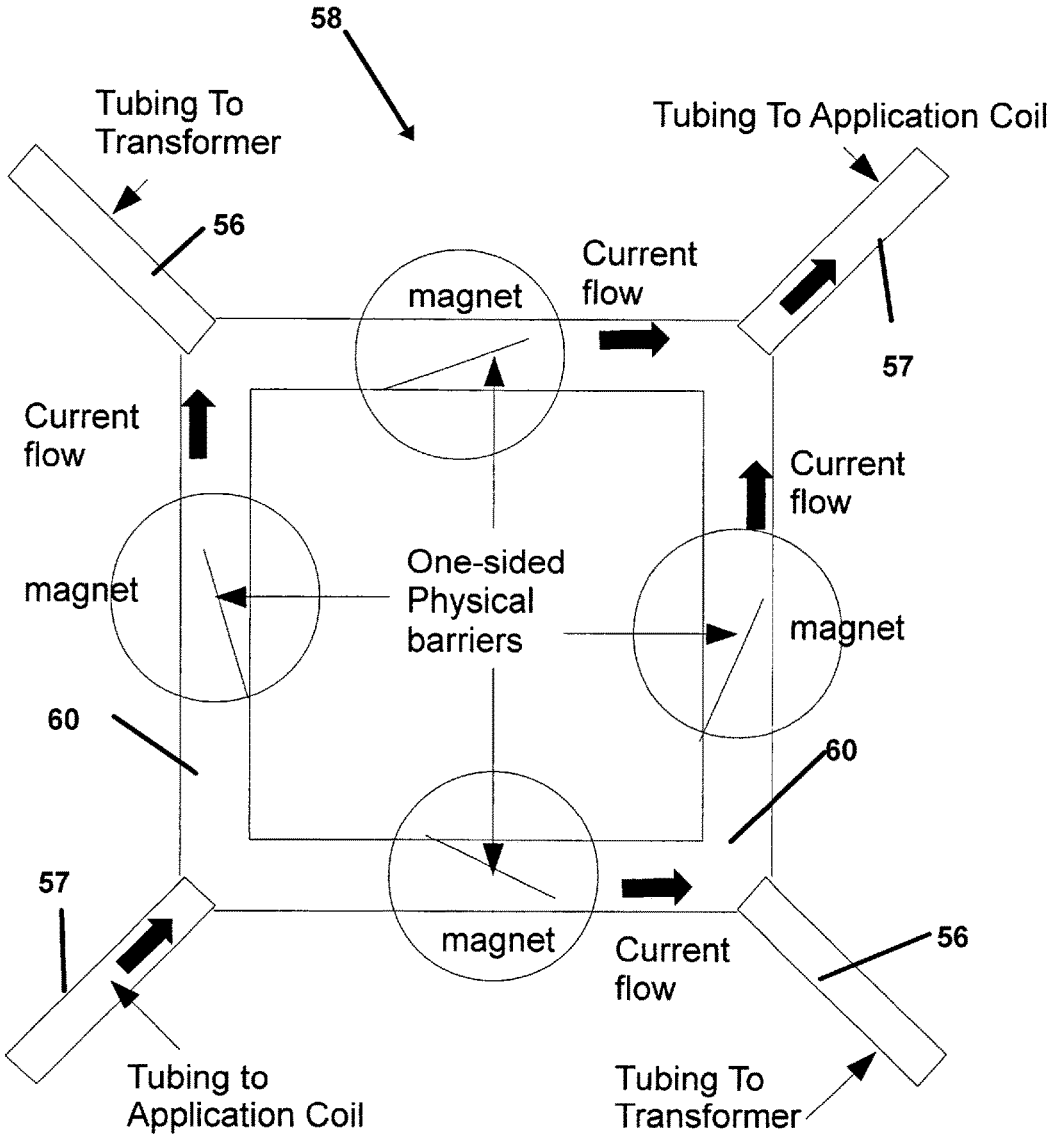
FIG. 5 shows a magnetic gate system for converting alternating directional flow of gaseous ions into a one-way flow thereof.

Optionally, the gaseous hydrated ions flowing through the tubing 56 of the transformer 50 can be channeled through one-way flow gates 58 shown in FIG. 5, in such a manner as to convert the alternating direction gaseous ion flow, into a one-direction ion gas flow. One such gating system for converting the alternating flow of hydrated hydrogen ions exiting the transformer 50 tubing 56, into one-direction flow of ions is shown in the diagram of FIG. 5 which depicts gaseous ions attempting to flow through the magnetic gate 58 system in an undesired direction. The ions are forced downward in the depicted gate 58 system by magnetic action into a physical trap, while ions flowing in the desired direction are forced upward into a physically open gate or valve, thus communicating the ion flow in the preferred single direction.

Tubing 56 that exits the transformer 50 that contains gaseous hydrated ions to which electromagnetic force has been applied has a flow though a looped channel 60 and back to the other end of the tubing 56 engaged around the core 52 of the transformer 50 to complete its circuit. All tubing 56 that flows within the transformer circuit and other tubing exterior to the separation component, is preferentially kept above 35° C. or even higher temperature.

In the case of either direct or alternating current flow of hydrated ions exiting and returning to the transformer 50, these flowing ions can be directed to flow into an application device that constitutes the third component of the present invention. A schematic representative of such a third component for flow of the hydrated ions through the transformer 50 and into one possible application circuit 57 to which this may be connected to the circuit 57 of the transformer in FIG. 4, is represented in FIG. 6.

Typically the hydrated ion transportation application component of the present device 10 herein, is comprised of a series of a conduit 62 formed to repeated overlapping loops or coils 63 in various geometric arrangements. This directs the flow of hydrated ions such that the electromotive force exerted by the flow of this charged gas is intensified to project a useful electromotive force.

Figure 7:
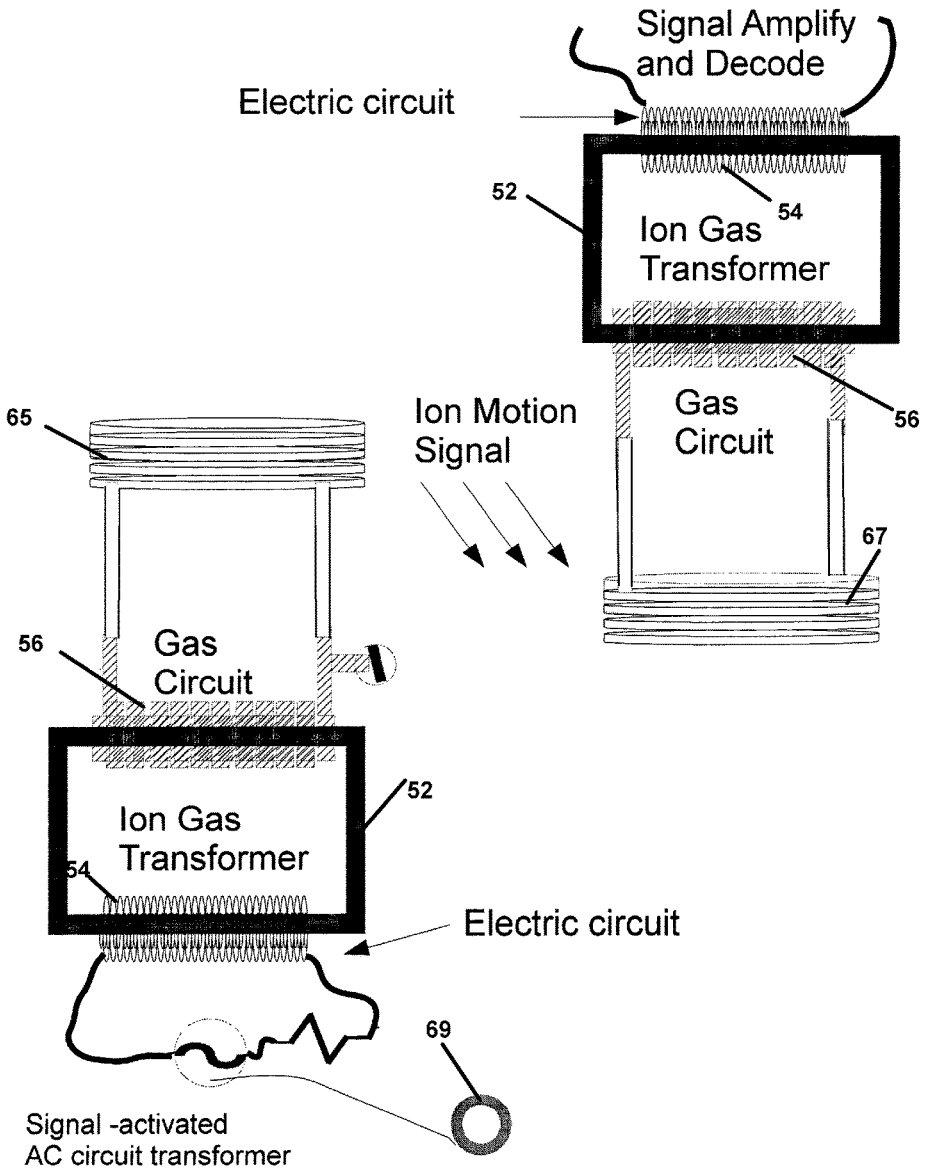
FIG. 7 shows a communications system employing the device of FIG. 6 for a signal transmitter and signal receiver.

The force that is projected by the third component of the present invention may be directed to electronic communications in which both receiving and transmitting apparatus are designed as illustrated schematically in FIG. 7. To clarify this schematic it can be understood that signals which emanate from signal-generating or transmitting hydrated hydrogen ion gas coils 65 within the diagram of FIG. 7, will induce weak motion of positive gaseous ions 33, contained in a similarly-constructed signal-receiving coil 67 located at some distance form the signal generating system. The weak motions of gaseous ions in the receiving coil 67 in turn induce a weak electric current in an electric wiring 54 on the opposite side of the core 52 of a signal-receiver transformer 50 in such a manner than this current or electric signal can be electronically amplified and deciphered. The transmitted signal might be input digital electrical signals or could be for instance an analog input from a microphone 69.

In modes of the device 10 herein which may be employed for locomotion of objects, a tubing of the present invention that contains hydrated ions of either positively-charged or negatively-charged population, in rapid motion, such as that show in FIG. 6, is placed in proximity to any object or surface that expresses all or part of an opposing direction positive ion flow through space. Under this condition a repulsive force is developed between the present invention device component, and the second object or surface with such force exhibiting utility for impelling motion to any object physically associated with either subject species.

Examples of such, without limiting the scope of this invention are provided for clarity. In example 1, an enabling mechanical design and operating method of the gaseous hydrated ion separation component and transportation device of the present invention is described in as follows:

1) A hot pressurized solution of 20.2% HCl dissolved in water in a pressure chamber, 2) A gas injection apparatus supplied by the above pressurized chamber that has an inlet into a set of the wire mesh screens (described below) attached to the outer perimeter of a rotatable wheel (described below) within a vacuum chamber housing, 3) A vacuum chamber housing composed of magnetic susceptible material, with ports for introducing ionizing microwave energy, and for removal of gaseous hydrated ions.

4) A rotatable wheel within the vacuum chamber housing,

5) A power drive for the wheel that is external to the vacuum chamber housing, 6) a large electromagnet or multiple smaller magnets with specified directional wiring located adjacent to the vacuum chamber housing, 7) two volume reservoirs in communication with and external to the vacuum chamber housing that are capable of receiving separately either gaseous hydrated hydrogen ions or gaseous hydrated chloride anions, and appropriate valving for controlling flow of materials during stages of the hydrated hydrogen ion separation operation.

More elaborate descriptions of these constituents of the first component of the present invention are given above and shown schematically in FIG. 1. (FIG. 1 does not detail the heated pressure tank of aqueous hydrochloric acid or the motor drive for the wheel assembly as these are considered obvious reductions.) The hot solution of 20.2% HCl in water is contained in an acid resistant pressure vessel that is valved to allow a slow controlled flow rate of azeotropic HCl/water vapor to be supplied to the wheel assembly within the vacuum chamber housing through a series of channeled flow apparatus as shown in FIG. 1, and discussed further below.

The vacuum chamber 12 within the housing 13 of the separation component of the present invention is constructed of magnetic-susceptible metal coated on its interior surfaces with PTFE or flexible graphite or other acid-resistant material. The chamber 12 seals and gaskets are also made of acid resistant material. The interior dimensions of the vacuum chamber 12 are constructed so as to allow room with close tolerance for a rotatable wheel 16. The vacuum chamber 12 preferably has on one side a flat surface that can physically form a close adjacency with a large electromagnet 28 or a number of smaller electromagnets 28. The vacuum chamber 12 has two gas exit ports comprising a second outlet 23 that exits to a gaseous hydrated chloride anion volume reservoir, and a first exit port 43 that exits to a gaseous hydrated hydrogen ion volume reservoir. A vacuum may be applied as needed through either port.

The vacuum so applied through a standard vacuum pump apparatus should have appropriate valving to isolate this vacuum source as desired during successive stages of the equipment's operation. The gaseous hydrated chloride anion reservoir is approximately equal in volume to the total volume of the separate hydrated hydrogen ion gas reservoir. The positively-charged hydrated hydrogen ions exiting the vacuum chamber travel through a hollow passage 37 leading to a cavity within the wheel hub 18 and then into the collection tubing, as is described in a following section.

A sacrificial surface or optionally the use of water-cooled PTFE tubing may enter on the non magnet side of the wheel housing 13 to provide absorption of any excess microwave energy during operation of the apparatus. Composition of the wheel 16, as noted, is preferably of non-magnetic material and coated on all exterior surfaces with PTFE or other acid resistant material.

A bearing assembly at the end of the wheel axle allows tubing to be continuous with the volume of the hollow axle of wheel hub partition that is the collection volume for gaseous hydrated hydrogen ions. This tubing and all tubing to which it is connected are coated with PTFE or other acid resistant material. This tube connected to the wheel hub volume exit is the transfer apparatus by which positively-charged hydrated hydrogen ions flow into a larger volume reservoir. This reservoir optionally consists entirely of PTFE coated tubing and may be regulated by valves at various useful locations. The means by which positively-charged hydrated hydrogen ions are transferred from the vacuum chamber 12 housing into the chamber of the wheel hub 18 is by a design feature of the wheel 16.

As noted, a circularly wound electromagnet 28 is located immediately adjacent to the vacuum chamber housing 13 and preferably has a diameter that is equal or greater than equal the diameter of the vacuum chamber housing 13. Optionally, a number of smaller electromagnets may be placed (instead of one single large magnet) around the circumference of the wheel housing so as to project a strong magnetic force on all segments of the wheel perimeter during operation.

The wiring of this electromagnet is arranged such that when any positive ions that are transported within the vacuum chamber 12 within the housing 13 in a direction similar to the direction of the wheel perimeter rotation into the communication area 27, they are impelled by the magnetic field to travel in direction toward the central wheel hub, (consistent with Lorentz criteria) while electrons traveling in the same direction as the outer wheel perimeter rotation are impelled by the magnetic field, to travel in a direction away from the wheel hub.

The tubular volume reservoirs of this example consist of 100 meters total of 0.5 cm outside diameter PTFE tubing or flexible graphite tubing that is connected to each side of the vacuum chamber, such that at the end of the gas pressurization cycle approximately 100 meters volume reservoir of anionic hydrated chloride gas is collected through the vacuum chamber top side exit port of the equipment, while concurrently approximately 100 meters of tubing containing hydrated hydrogen ion gas is collected through the wheel hub portion of the equipment. Either tubing volume reservoir of these gaseous hydrated ions can be subsequently utilized in the transformer and application transportation components systems of this invention.

As described earlier, a second gaseous hydrated ion transportation component of the present invention is a gas ion transformer system that can transfer energy and induce rapid motion of the gaseous ions within its tubing travel circuit. The gas ion transformer of the present invention consists of a ring of magnetic susceptible metal that is shaped in a rectangular loop similar to a standard transformer design as shown in FIG. 4 with derivatives in FIGS. 6 and 7.

This core of the transformer may optionally have cooling capability. The size of the core is optional but in the case of this example which in no way is limiting, the central solid core of magnetic susceptible metal has dimensions of a 5 cm wide and 5 cm high square shape with a rectangle length of 25 cm and a width of 15 cm. One 25 cm long side of the core is wrapped with 800 loops of 6 gauge high temperature insulated electrical wiring connected to an alternating current electrical power source. Around the second 25 cm long side of the transformer core, is wrapped a coil of PTFE or flexible graphite tubing that contains the gaseous hydrated ion plasma recovered from the vacuum chamber wheel housing component of the present invention.

This 25 cm side of the transformer is coiled with 80 loops of the gaseous hydrated ion-containing PTFE tubing. The tubing of gaseous hydrated ions exiting the transformer are connected through both ends to an application system for utilization of these moving ionic charges when these are in their accelerated state. Electrical power on the order of 110 volts at 60 Hz frequency can be applied to the side of the transformer wrapped with the 6 gauge insulated electrical wire. This preferentially will employ a variable resistance of 10-1000 ohms in that same electrical circuit to control its electron current flow rate.

The loop of gaseous hydrated ion current that circulates through the transformer can be employed as-is in its alternating direction current form, or this can be converted into a one-way direction ion flow by means of a magnetic gate system. The magnetic gate system that is operable for this current conversion requires a series of four one-way magnetic "gates" that are shown in FIG. 5.

The operation of these gates blocks the flow of gaseous hydrated ions from moving in one direction but not the other intended directional flow. The magnetic gate blocking action is created by both a physical trap barrier and a magnetic field that forces moving ions downward in the field into the physical barrier when these charges are moving in the undesired direction through the gate, and the same magnetic field forces these charges upward in the field thereby avoiding the physical barrier when these gaseous hydrated ions are moving the desired direction. The positioning of the electromagnets that perform the blocking function in conjunction with physical blockades of positive ion flow is illustrated schematically in FIG. 5.

General operation of the first two components of the present invention device begins with evacuation of the entire system, including the primary vacuum chamber housing, the positive ion tubing reservoir, including the transformer system and its application circuit, as well as the gaseous anion tubing reservoir. Separately, a pressure chamber containing 20.2% hydrochloric acid in 78.8% water is heated to about 200° C. This pressure chamber is connected with insulated tube through valving that is in turn connected to a valve mechanism that can inject vapor into the vacuum chamber housing under valved control.

The vacuum chamber 12 within the housing 13 and all of its connected reservoirs are all evacuated to about 0 Pascal pressure by employing a vacuum pump connected with valving to the anion reservoir system. After complete system vacuum is attained the vacuum pump is valve-isolated from the wheel housing and the two volume reservoirs that remain under 0 Pascal pressure. At that time, rotation of the mechanical wheel 16 to a perimeter velocity of greater than 100 meter/second is then enacted. In a next operating step the electromagnet 28 adjacent to the vacuum chamber housing 13 is energized to yield a magnetic flux intensity of approximately 40,000 Gauss or greater. As a next step a pressurized stream of −200° C. hot 20.2% hydrogen chloride aqueous vapor is slowly injected by valve control into the communication area 27 in the vacuum chamber 12 at the wheel's outer perimeter in the layered mesh screens, through its tubular apparatus directly into the middle layer of these mesh screens. Simultaneous with this action microwave energy is directed into the mesh screens on the outer wheel perimeter to ionize the hydrated hydrogen chloride molecules and so form separate oppositely-charged gaseous ions.

The hot vaporized hydrated hydrogen chloride pressurized gas flow into the wheel and to the communication area 27 is continued until the overall system pressure reaches just below 5000 Pascal pressure. After the system reaches the target pressure the exit valve on the hydrated hydrogen ions-containing tubing exiting the wheel hub is closed so that the tubing reservoirs containing either gaseous hydrated hydrogen ions or gaseous hydrated chloride anions are both isolated from the wheel housing. At that time the hot pressurized gas stream and the microwave energy inputs are discontinued and the electromagnet 28 is deactivated and the wheel 16 rotation is stopped.

All exterior tubing containing gaseous hydrated hydrogen ions or chloride anions should preferably be subsequently maintained at temperatures above 35° C. The tubing reservoirs that contains either hydrated hydrogen ions or hydrated chloride anions, are next employed for further transportation functions within the transformer and application components of the present invention. The entrance valve that feeds either one or both of the gaseous hydrated ions into its individual transformer system is then closed.

This hydrated ion gas flow can be directed to flow into a one-way magnetic gate system as shown in FIG. 5 and thereafter utilized in the third component of the present invention application systems as described below. Or optionally, the alternating gaseous flow ions can be directed as-in into the third component of the present invention.

In a third component of the present invention is an application system that consists of an application loop with connections both leaving and returning to the transformer system, or its attendant one-way magnetic gate system, on either end as shown in FIG. 5. This third component of the present invention can be employed for multiple applications, including communications and locomotion of objects.

The third component of the present invention directs the moving gaseous hydrated ions exiting the transformer coil into geometrical flow patterns useful for applications. Repeated overlapping of multiple loops of the gaseous ion-containing tubing connected to the transformer circuit are employed in order to intensify the projected force of these moving charges. A typical geometrical pattern is shown in FIG. 5.

The use of such a coiled multiple-loop system for communications purposes and locomotive purposes are described separately below. In the case of communications applications the use of gaseous positively charged hydrated hydrogen ions is preferred over the anionic gas mode of the present invention. In this case the electrical current within the transformer component of the present invention may be voice-activated or other signal-activated by a standard microphone or other signal generating device which triggers an amplified current flow within the electrically-powered segment of the transformer system of the present invention as is standard practice in the art of electronics This converted amplified signal within the electric circuit of the transformer transfers energy to its associated tubing that contains positively-charged gaseous hydrated hydrogen ions. In turn these accelerated ions exiting the transformer are directed to a circular multiple-looped application coil through which the gaseous hydrated hydrogen ions flow in continuation with the transformer as shown in FIG. 6.

Thus the multiple-looped coil containing hydrated hydrogen ions of FIG. 6 is subjected to the amplified currents from the voice-activated transformer, and this becomes in effect a voice-signal transmitter. This voice-signal system in turn induces positive ion motion in any similarly-designed looped coil system containing positive gaseous ions within an effective receiving distance, and so such a receiving coil, as illustrated in FIG. 7 acts as a signal-detecting receiver.

In the operation of such a receiver system a signal received from the transmitter coil induces slight motion of the gaseous hydrated hydrogen ions within the receiver multiple-looped application coil of FIG. 7. This slight positive ion motion induced in the receiver coil in turn induces a slight current in the electrical circuit of its attached transformer, that can in turn be amplified and translated electronically into the original signal by means standard in the art of electronics.

In a second example in a case where the application of locomotive force is a desired useful objective of the present invention the first two components of the present invention, including the gaseous ion isolation vacuum chamber 12 with rotating wheel and the transformer component, are configured and operated in a manner that is identical to Example 1 above.

As a modification of this $2^{nd}$ example the third component of this invention comprises a multiple-loop one meter circumference circular coil arrangement of tubing containing gaseous hydrated ion flow of either charge type circulating through a transformer system, as described above, and deployed as shown in FIG. 6. In this case significant energy of up to 10,000 Watts or greater can be applied to the electrically-powered side of the transformer that in turn transfers accelerating energy to the gaseous ions within the tubing segment of the transformer.

When this tubing, which contains gaseous hydrated ions in rapid motion, is placed in proximity to any object or surface that expresses all or part of an opposing directional ion flow through space, this action produces a repulsive force between the looped tubing component of the present invention and the second subject species. Thus, a physical attachment between the present invention's third component to any target object is thereby useful for impelling force and motion to such an object, when such an object is located in proximity to a field containing an opposing directional ion flow. By such means, novel construction motors or lifting apparatus of various types are possible with the present invention.

One unique application effect, although not limiting, of the present invention's use of gaseous ion flow for locomotive purposes of objects is that this practice avoids the known adverse electronic interference effects known to affect standard electronic communications devices that are subjected to close proximity of standard electric motors.

The system herein, used in a method for separating gaseous positively-charged hydrated hydrogen ions 33, from their associated gaseous hydrated anions 49 in a gaseous mixture 31 of associated ions, would operate as noted above by spinning the wheel 16 having a perimeter edge surrounded by a screen mesh 26 engaged thereto within the communication area 27, while in a vacuum chamber 12. A hot gaseous mixture 31 of associated ions flows to the communication area 27 within the vacuum chamber 12 where ionizing microwave energy is communicated concurrently in the communication area 27 within said vacuum chamber 12. At the same time, an electromagnet 28 positioned proximal to the vacuum chamber 12 is energized with electric current to cause it to communicate a magnetic field, to said communication area 27 while the gaseous mixture 31 is therein. The direction of the generated field is purposely configured using a wiring direction for the electric current, to cause the gaseous mixture 31 of associated ions within the communication area 27 to split into a first population of positively-charged hydrated hydrogen ions 33 and a second population of gaseous hydrated anions 49. The two populations separated from the mixture 31 may be employed for any purpose desired by the user at this juncture.

To employ the two populations for communication and/or locomotion, the user will collect one population such as the positively-charged hydrated hydrogen ions 33 in a first reservoir exterior to the vacuum chamber 12. They will collect a second population separated from the gaseous mixture 31 in a second reservoir exterior to the vacuum chamber 12.

Then, one of the first population or said second population will be passed through a coiled conduit on a first side of an electric transformer while concurrently communicating an electric current to a wire coiled around a second side of said electric transformer opposite said first side. The communication of the electric current is continued for a time needed to accelerate the chosen first population or second population through said coiled conduit to concurrently cause a generation of electrically induced force therefrom. In this method, this force, may then be employed for either locomotion of objects as noted herein, or for remote communication as noted herein.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention or claims herein. Consequently, all such modifications and variations and substitutions are included within the scope of the invention as defined by the following claims.

What is claimed is:

1. An apparatus for separating associated ions within a gaseous fluid stream into a first population of positively-charged hydrated hydrogen ions, and a second population of gaseous hydrated anions, comprising:

a housing having a wall defining a chamber therein, said chamber having negative pressure therein defining a vacuum;

a wheel spinning on hub, said wheel and said hub located within said chamber;

a first plurality of spokes communicating between a first cavity located in said hub and a perimeter edge of said wheel;

a second plurality of spokes communicating between said hub and said perimeter edge of said wheel;

a mesh screen assembly located on said perimeter edge of said wheel;

a first conduit communicating along an axial passage of at least one of said first plurality of spokes, between said first cavity and an exit port at said perimeter edge of said wheel adjacent said mesh assembly;

a second conduit communicating along an axial pathway of at least one of said second plurality of spokes, between an entry port at said perimeter edge adjacent said screen and a second cavity;

said first cavity having an entry for receiving said gaseous fluid stream for a communication thereof along said first conduit to an exit thereof from said exit port;

a magnet positioned proximate to said housina, said magnet communicating a magnetic field to a communication area thereof with said mesh screen assembly within said chamber;

a microwave energy generation component situated for a communication of microwaves to said communication area; and said magnetic field in combination with said microwaves in said communication area defining a separation force contacting said associated ions in said gaseous fluid stream exiting said exit port into said communication area;

said separation force dividing said associated ions in said gaseous fluid into a first population of positively-charged hydrated hydrogen ions, and a second population of gaseous hydrated anions; and a first reservoir in sealed communication with said chamber for collecting said first population of positively-charged hydrated hydrogen ions therein; and a second reservoir in sealed communication with said chamber for collecting said second population of gaseous hydrated anions therein.

2. The apparatus of claim 1 additionally comprising:

said magnetic field generated by a flow direction of electric current through an electromagnet in a direction to induce said separation force to propel said first population of positively-charged hydrated hydrogen ions in a first direction toward said hub and into said entry port of said second conduit;

said second conduit in said sealed communication with said first reservoir; and said magnetic field so configured inducing said separation force to propel said second population of gaseous hydrated anions in a second direction, opposite said first direction and into an exit port communicating between said second reservoir and said chamber.

3. The apparatus of claim 1 additionally comprising:

a first coiled conduit having a coil passage running therethrough in sealed engagement with a chosen one of said first reservoir or said second reservoir;

said first coiled conduit coiled around a first side of a first electric transformer;

a wire coiled around a second side of said first electronic transformer, opposite said first side thereof;

an electric current connectable in a flow through said wire;

said flow of said electric current causing an acceleration of either said first population of positively-charged hydrated hydrogen ions flowing to said coil passage from said first reservoir, or said second population of gaseous hydrated anions flowing to said coil passage from said second reservoir, depending upon said chosen one from said first reservoir or said second reservoir; and said acceleration generating a first electrically induced force in a direction away from said first coiled conduit, whereby said first electrically induced force is employable for locomotion of objects and for electronic communication.

4. The apparatus of claim 2 additionally comprising:

a first coiled conduit having a coil passage running therethrough in sealed engagement with a chosen one of said first reservoir or said second reservoir;

said first coiled conduit coiled around a first side of a first electric transformer;

a wire coiled around a second side of said first electronic transformer, opposite said first side thereof;

an electric current connectable in a flow through said wire;

said flow of said electric current causing an acceleration of either said first population of positively-charged hydrated hydrogen ions flowing to said coil passage from said first reservoir, or said second population of gaseous hydrated anions flowing to said coil passage from said second reservoir, depending upon said chosen one from said first reservoir or said second reservoir; and said acceleration generating a first electrically induced force in a direction away from said first coiled conduit, whereby said first electrically induced force is employable for locomotion of objects and for electronic communication.

5. The apparatus of claim 3 employable for said electronic communication and additionally comprising:

a second coiled conduit having a coil passage running therethrough in sealed engagement with the other of said chosen one of said first reservoir or said second reservoir;

said second coiled conduit coiled around a first side of a second electric transformer;

a second wire coiled around a second side of said second electronic transformer, opposite said first side thereof;

said electric current connectable to said first transformer, in an amplified flow through said wire engaged to said first transformer;

said first electrically induced force communicated to said second coiled conduit generating a secondary acceleration of the other of said first population of positively-charged hydrated hydrogen ions communicated to said coil passage of said second coiled conduit from said first reservoir, or said second population of gaseous hydrated anions communicated to said coil passage of said second coiled conduit from said second reservoir, depending upon said chosen one from said first reservoir or said second reservoir; and said secondary acceleration generating a received electric current in said second wire mimicking said amplified flow of said electric current to said first transformer, whereby said received electric current is employable to discern signals in an electronic communication.

6. The apparatus of claim 4 employable for said electronic communication and additionally comprising:

a second coiled conduit having a coil passage running therethrough in sealed engagement with the other of said chosen one of said first reservoir or said second reservoir;

said second coiled conduit coiled around a first side of a second electric transformer;

a second wire coiled around a second side of said second electronic transformer, opposite said first side thereof;

said electric current connectable to said first transformer, in an amplified flow through said wire engaged to said first transformer;

said first electrically induced force communicated to said second coiled conduit generating a secondary acceleration of the other of said first population of positively-charged hydrated hydrogen ions communicated to said coil passage of said second coiled conduit from said first reservoir, or said second population of gaseous hydrated anions communicated to said coil passage of said second coiled conduit from said second reservoir, depending upon said chosen one from said first reservoir or said second reservoir; and said secondary acceleration generating a received electric current in said second wire mimicking said amplified flow of said electric current to said first transformer, whereby said received electric current is employable to discern signals in an electronic communication.

7. A method for separating gaseous positively-charged hydrated hydrogen ions, from their associated gaseous hydrated anions in a gaseous mixture of associated ions, comprising:

spinning a wheel having a perimeter edge surrounded by a screen mesh engaged thereto defining a communication area, within a vacuum chamber;

introducing a hot gaseous mixture of associated ions into said communication area withing said vacuum chamber;

communicating ionizing microwave energy to said communication area within said vacuum chamber;

energizing an electromagnet proximal to said vacuum chamber with electric current to thereby communicate a magnetic field to said communication area using a wiring direction for said electric current to cause said gaseous mixture of associated ions within said communication area to split into a first population of positively-charged hydrated hydrogen ions and a second population of gaseous hydrated anions; and collecting said first population in a first reservoir exterior to said vacuum chamber and collecting said second population in a second reservoir exterior to said vacuum chamber.

8. The method of claim 7 additionally comprising the steps of:

communicating one of said first population or said second population through a coiled conduit on a first side of an electric transformer;

communicating an electric current to a wire coiled around a second side of said electric transformer opposite said first side;

continuing communicating said electric current as a to accelerate said first population or said second population through said coiled conduit causing a generation of electrically induced force therefrom; and employing said electrically induced force for locomotion of objects or for remote communication.

* * * * *